United States Patent [19]

Tittl

[11] 4,231,125

[45] Nov. 4, 1980

[54] BEACH TOWEL FOR USE WITH A PILLOW

[76] Inventor: Joseph F. Tittl, 1405 Eastcrest Dr., Apt. 201, Charlotte, N.C. 28205

[21] Appl. No.: 52,565

[22] Filed: Jun. 27, 1979

[51] Int. Cl.[3] ..... A47G 9/06

[52] U.S. Cl. ..... 5/419; 5/485

[58] Field of Search ..... 5/417, 418, 419, 420, 5/413, 416, 485, 462, 434, 495, 486

[56] References Cited

U.S. PATENT DOCUMENTS

| | | | |
|---|---|---|---|
| 65,262 | 5/1867 | Ouroussoff | 5/420 |
| 1,324,009 | 12/1919 | Hope . | |
| 1,930,942 | 10/1933 | Pringle . | |
| 2,264,471 | 12/1941 | Glenn | 5/419 |
| 2,898,609 | 8/1959 | Storie . | |
| 3,176,315 | 4/1965 | Freund . | |
| 3,284,819 | 11/1966 | Nissen | 5/420 |
| 3,508,285 | 4/1970 | Marquette | 5/486 |
| 3,579,675 | 5/1971 | Scheer . | |
| 3,689,947 | 9/1972 | Wolf | 5/419 |
| 3,851,346 | 12/1974 | Fillmore | 5/485 |
| 4,097,944 | 7/1978 | Yulish . | |

FOREIGN PATENT DOCUMENTS

| | | | |
|---|---|---|---|
| 339419 | 12/1930 | United Kingdom | 5/485 |

*Primary Examiner*—Roy D. Frazier
*Assistant Examiner*—Alex Grosz
*Attorney, Agent, or Firm*—W. Thad Adams, III

[57] ABSTRACT

A beach towel or the like for use with a pillow, and characterized by simplicity and economy of construction, and the use of elements substantially impervious to corrosion by salt and damage from sand. The beach towel comprises an elongate, substantially rectangular fabric piece defining opposing, laterally extending top and bottom end edges and opposing, longitudinally extending side edges. A pair of longitudinally spaced-apart and laterally extending attachment members are secured to the fabric piece proximate its top end for permitting the top end of the fabric piece to be folded over itself and releasably attached in such position to form a tube for enclosing a pillow. One of the attachment members comprises a patch having numerous rows of hook-like projections, and the other of the pair of attachment members comprises a patch of loose, fibrous, non-woven material for releasably interlocking with the hook-like projections.

2 Claims, 7 Drawing Figures

FIG. 2
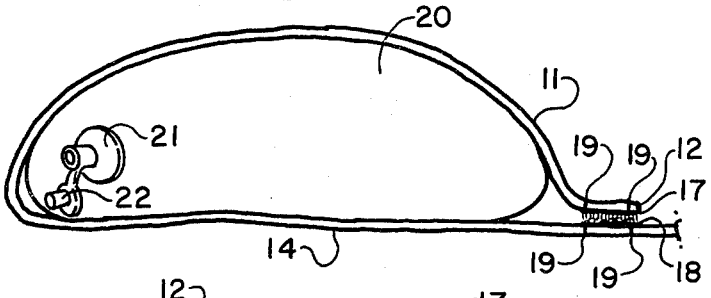
FIG. 3
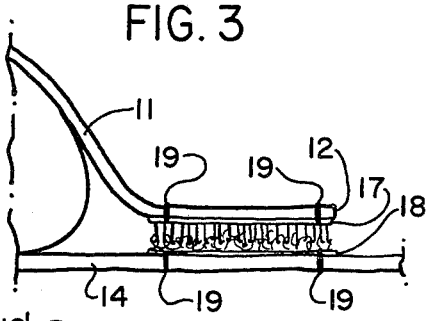
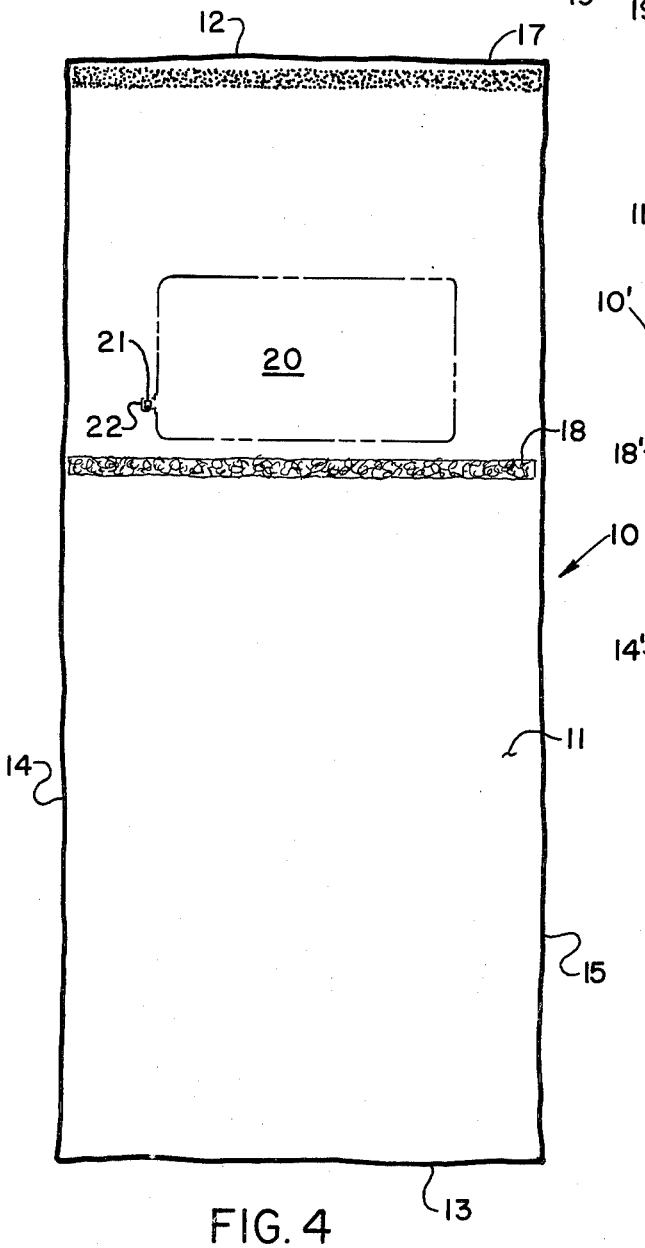
FIG. 4
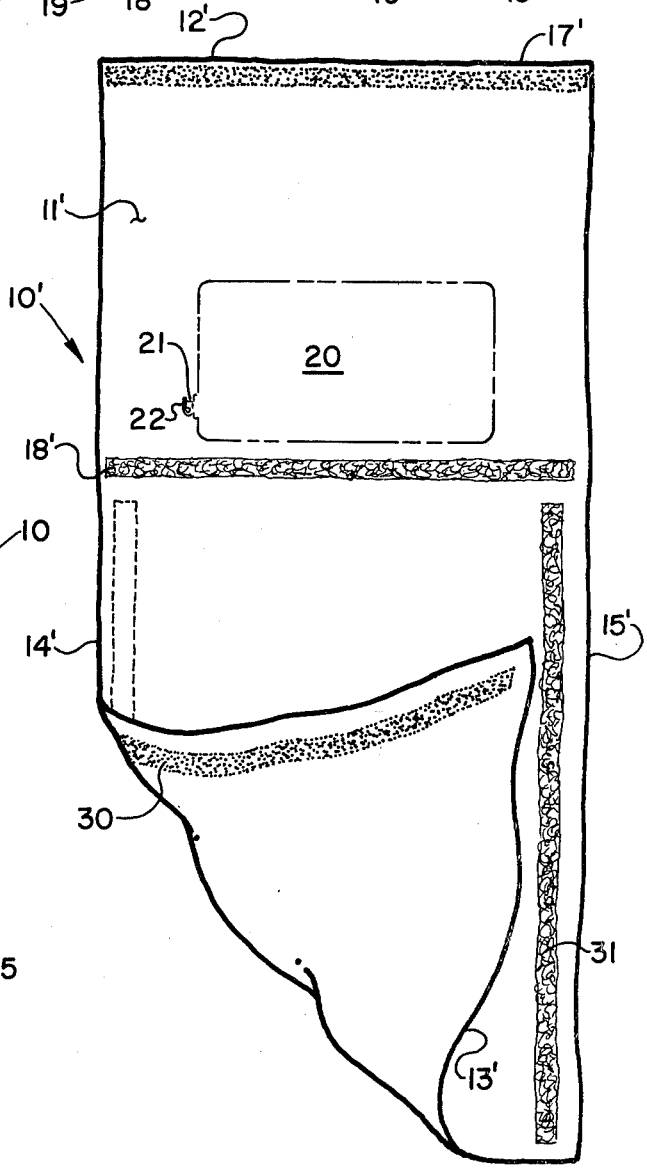
FIG. 5

FIG. 6
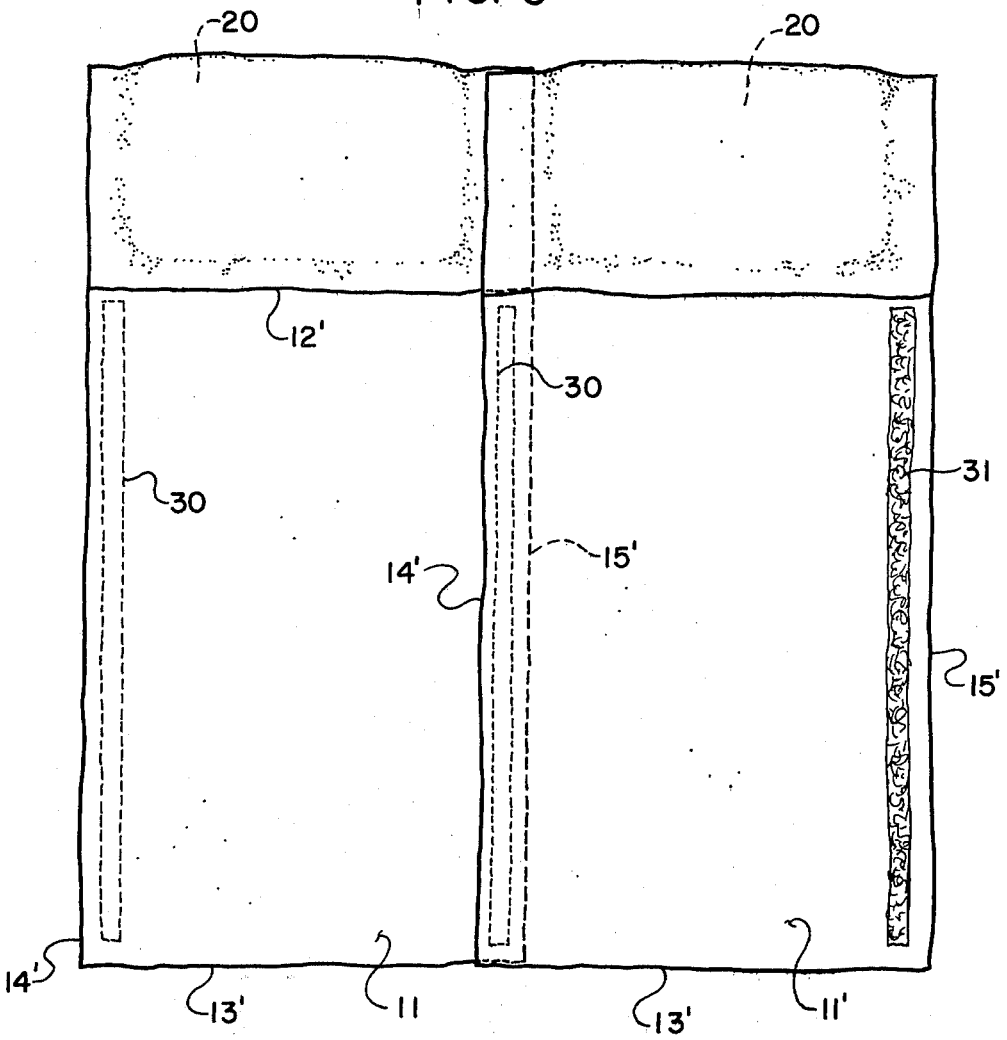
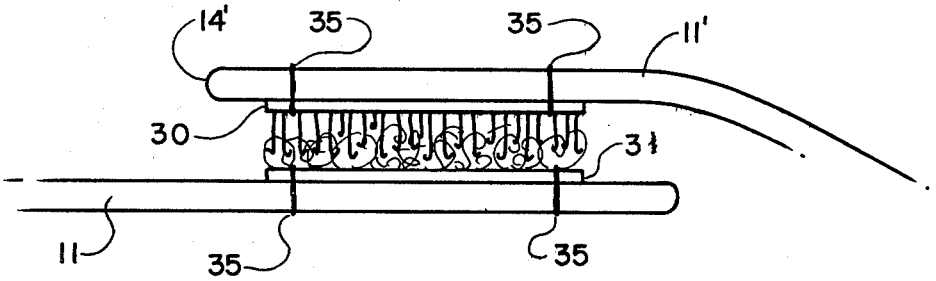
FIG. 7

BEACH TOWEL FOR USE WITH A PILLOW

BACKGROUND OF THE INVENTION

This invention relates to a beach towel or the like for use with a pillow.

Towels and blankets are commonly used by individuals at beaches and swimming pools to form a relatively clean and comfortable surface on which to lie. Such towels and blankets are particularly useful on beaches, since they protect the individual from the discomfort of lying in direct contact with the sand, and prevent salt and sand from sticking to the individual's body. Since these towels and blankets inherently provide no support for or comfort to the head and neck of the individual, it is customary to use folded clothing articles or other towels as a pillow.

The desirability of the use of a pillow in conjunction with a beach towel or blanket has been recognized and disclosed in previous patents. For example, in the Storie U.S. Pat. No. 2,898,609, a "beach pack"is disclosed which comprises a bag for carrying beach and bathing paraphernalia. The pack includes a body portion, which in its unfolded state is used as a beach blanket. At least one pocket is sewn onto the body portion into which the body portion when folded, can be inserted for storage. The pocket can also be used to carry beach paraphernalia such as bathing suita, towels and the like. With the body portion in its unfolded state, the pocket serves as a cover for a pillow.

The Freund U.S. Pat. No. 3,176,315 disclosed a combination beach robe and blanket. Included in the disclosed structure is an air-tight bladder which is enclosed within a pocket on one end of the blanket by means of sewing and serves as a pillow.

The Yulish U.S. Pat. No. 4,097,944 discloses a beach mat having an integral pillow sewn onto one end, and defining side pockets within which to carry beach wear and the like.

The Pringle U.S. Pat. No. 1,930,942 discloses a sheet adapted to be spread upon the ground. One end of the sheet is formed into a bag to contain the remainder when folded. The invention also includes a cushion which can be detachably secured to one end of the sheet by means of snaps, and a rigid member to serve as a back or head rest for the user. The Glenn U.S. Pat. No. 2,264,471 discloses a beach blanket having storage pockets formed on one end by folding the blanket upon itself and stitching longitudinally along its sides. The open, laterally extending side is closed by means of either sliding or zipper fasteners.

The Shear U.S. Pat. No. 3,579,675 and the Hope U.S. Pat. No. 1,324,009 each show different methods of incorporating a pillow or head rest into a sleeping bag or case.

As is apparent from the foregoing, efforts have been previously made to provide for the use of a pillow in combination with a beach towel or blanket. The use of sewing as a means of permanently incorporating a pillow into a towel limits the other uses to which the towel might otherwise be put since the pillow cannot be removed without breaking the sewing. The permanent placement of a pillow within the towel or blanket likewise makes it difficult to keep the towel or blanket clean, since sand or salt accumulates within the sewn pillow pocket is difficult to remove. Likewise, the use of metal snaps or zippers to form pockets presents the dual problem of corrosion and damage from salt and sand, respectively.

SUMMARY OF THE INVENTION

Accordingly, it is an object of this invention to provide a beach towel or the like which is characterized by simplicity and economy of construction, and the use of elements substantially impervious to corrosion by salt or damage from sand.

Another object of the invention is to provide a beach towel which can be releasably attached to other like beach towels side to side to form an oversized towel for use by several persons, and to aid in preventing blowing of the towels by wind.

These and other objects and advantages of the present invention are achieved in the preferred embodiment set forth below by providing an elongate, substantially rectangular fabric piece defining opposing, laterally extending top and bottom end edges and opposing, longitudinally extending side edges. A pair of longitudinally spaced apart and laterally extending attachment members are secured to the fabric piece proximate its top end for permitting the top end of the fabric piece to be folded over itself and releasably attached in such position to form a tube for enclosing a pillow. The pair of attachment members comprises a patch having numerous rows of hook-like projections, and the other of the pair of attached members comprises a patch of loose, fibrous, non-woven material for releasably interlocking with the hook-like projections.

One of the preferred embodiments disclosed below also includes means for releasably attaching a plurality of the towels together side to side to form an oversized towel for use by several persons, and to aid in preventing blowing of the towels by wind. The means preferably comprises a patch of hook-like projections secured to one face of the fabric piece closely adjacent one of its side edges, and a patch of loose, fibrous non-woven material secured to the other face of the fabric piece closely adjacent its other side edge. A plurality of the towels may thereby be releasably secured to one another by overlapping their adjoining side edges and releasably interlocking the hooklike projections on one towel with the loose, fibrous non-woven material on another towel.

BRIEF DESCRIPTION OF THE DRAWINGS

Some of the objects of the present invention have been set forth above. Other objects and advantages will appear as the description of the invention proceeds, when taken in conjunction with the following drawings, in which:

FIG. 2 is a vertical cross section of the portion of the beach towel which is folded over itself to form a tube for enclosing a pillow;

FIG. 3 is an enlarged, fragmentary vertical cross-section of the portion of the beach towel shown in FIG. 2, and particularly showing the detail of the attachment members;

FIG. 4 is a top plan view of one embodiment of the present invention, showing the proper positioning of the pillow;

FIG. 5 is a top plan view of a second embodiment of the present invention and including means secured to the opposing, longitudinally extending sides of the towel for use in attaching, side to side, a plurality of towels according to the present invention;

FIG. 6 is a top view of the second embodiment of the present invention and showing two identical towels attached together, side to side; and FIG. 7 is a vertical cross-section of the beach towel shown in FIG. 6, and particularly showing the detail of the attachment members.

DESCRIPTION OF THE PREFERRED EMBODIMENTS

Figure 1:
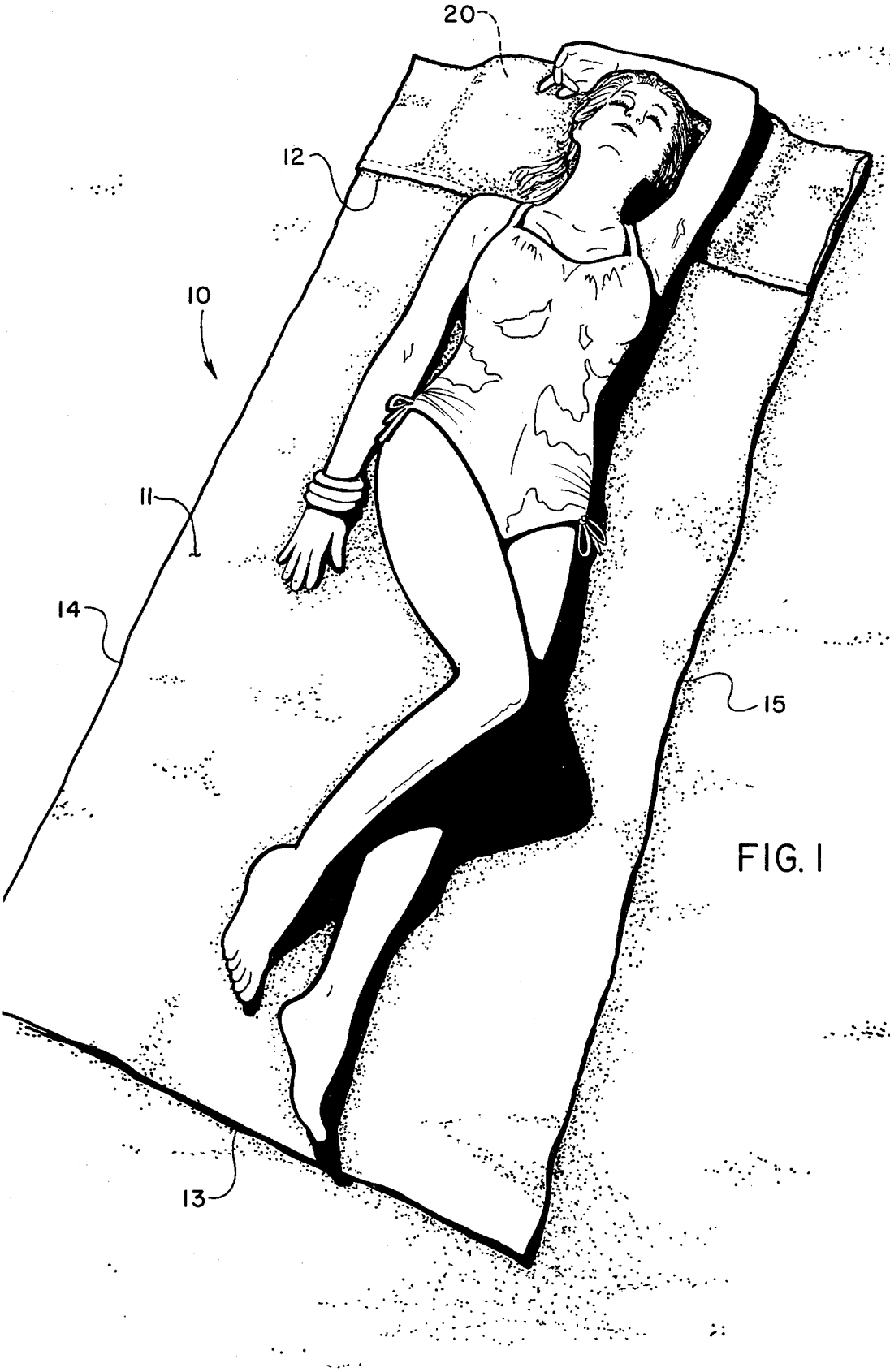
FIG. 1 is a perspective view of a beach towel according to one of the preferred embodiments of the present invention, and showing for illustrative purposes a suitably clad female figure reclining on it.

Referring now specifically to the drawings, a beach towel according to one of the preferred embodiments is shown in FIG. 1 and indicated broadly by reference numeral 10. The towel comprises an elongate, substantially rectangular fabric piece 11, preferably constructed to single or double face terry toweling. As is also shown in FIG. 1, the substantially rectangular fabric piece 11 defines opposing, laterally extending top and bottom end edges 12 and 13, respectively, and opposing, longitudinally extending side edges 14 and 15.

Referring to FIG. 4, a pair of longitudinally spaced-apart and laterally extending attachment members 17 and 18 are secured, preferably by sewing, to the fabric piece 11 proximate its top end. Attachment member 17 comprises a patch, extending substantially the entire lateral width of the fabric piece 11 and having numerous rows of hook-like projections extending outwardly from its base and is commonly referred to as "male" Velcro.

Attachment member 18 comprises a longitudinally extending patch of loose, fibrous, non-woven material, commonly referred to as "female" Velcro. In each case, the term "Velcro" is a trademark for the material described.

A pillow 20 is shown in FIG. 4 positioned intermediate attachment member 17 and attachment member 18, closely adjacent the attachment member 18. The pillow 20 is enclosed within that portion of the fabric piece 11 intermediate attachment members 17 and 18 by folding the top end of the fabric piece 11 over itself in such manner that the hook-like projections on the attachment member 17 releasably interlock with the loose, fibrous, non-woven material of the attachment member 18. As is shown in FIG. 2, the pillow 20 may preferably be an inflatable plastic or rubber pillow which is small and of a compact size when deflated, and which may be inflated to form a comfortable pillow by inhaling into a valve 21 until the correct inflation is obtained. The valve 21 is then closed by inserting a valve plug 22 into its orifice.

Referring now more specifically to the attachment members 17 and 18, FIG. 3 presents an enlarged view of the attachment members 17 and 18, each secured by sewing stitches 19 to the same face of the fabric piece 11. As is also shown, the hooklike projections of the attachment member 17 are entangled within the loose, fibrous, non-woven material comprising the attachment member 18 by pressing the attachment members 17 and 18 against each other. In this manner, the top end of the fabric piece 11 is held in releasable attachment with the fabric piece 11 to form a tube within which the pillow 20 is placed.

While the attachment member 17 and 18 are shown extending substantially the entire width of the fabric piece 11, further economy may be realized by providing a plurality of relatively short attachment members 17 and 18 suitably secured to the fabric piece 11 at laterally extending intervals, as desired.

Conventional beach towels are sold in a wide variety of sizes. One standard size for a beach towel is 30 inches in width by 72 inches in length. Because the top of the beach towel according to the present invention is folded over itself to form a tube within which to enclose the pillow 20, it is preferably to use a beach towel having extra length, in order that the fabric piece 11, while enclosing the pillow 20 is of approximately the same length as would be a conventional beach towel. For this reason, the fabric piece 11 according to the present invention is extended approximately 16 inches, to accommodate a pillow approximately 10 inches in width and 3 to 4 inches in height, when inflated. The remainder of the extra length is provided in order to allow some latitude of pillow size and the degree of inflation.

Of course, if desired, a non-inflatable pillow or even folded clothing or another towel can be used as a pillow and likewise enclosed within the tube formed by folding the top end of the fabric piece 11 over itself and interlocking the attachment members 17 and 18.

As is shown in FIGS. 3 and 4, the attachment member 17, comprising the patch of hooklike projections, is secured to the fabric piece 11 closely adjacent its top end edge 12, rather than toward the middle. In this manner, if the towel is being used in its open form without a pillow the person lying on the towel need not lie on the patch of hooklike projections, which because of their stiff outwardly projecting structure, would be rather uncomfortable. Since the attachment member 18 is formed merely of the patch of loose, fibrous, non-woven material, little or no discomfort would result from lying on the patch itself. Hence, it is preferable to place the attachment member 18 in the more central position on the fabric piece 11, as is shown in FIG. 4.

While this preferred embodiment discloses the attachment members 17 and 18 being secured to the same face of the fabric piece 11, substantially the same result may be achieved by securing the attachment member 17 to the opposing face of the fabric piece 11. (Not shown). In this event, it would be necessary to fold the upper end edge 12 of the fabric piece over itself once before bringing the attachment member 17 into releasably interlocking position with the attachment member 18.

A second embodiment according to the preferred invention is shown in FIGS. 5 and 6 and generally designated at reference numeral 10'. The beach towel 10' comprises an elongate, substantially rectangular fabric piece 11' defining opposing, laterally extending top and bottom end edges 12' and 13', respectively, and longitudinally extending side edges 14' and 15' as is disclosed above and shown in FIGS. 1 and 4. Likewise, a pair of longitudinally spaced-apart and laterally extending attachment members 17' and 18' are secured to the fabric piece 11' proximate its top end and comprising, respectively, a patch having numerous rows of hooklike projections and a patch of loose, fibrous non-woven material, as is shown in FIGS. 3 and 4.

In addition, means are provided for releasably attaching a plurality of the towels 10' together side to side to form a single oversized towel for use by several persons, and to aid in preventing blowing of the towels by wind. The means for releasably attaching the towels 10' together side to side comprise a patch of hook-like projections 30 secured to one face of the fabric piece 11' closely adjacent the side edge 14', and a patch of loose, fibrous, non-woven material 31 secured to the other face of the fabric piece 11 closely adjacent the side edge 15'. As with the attachment members 17' and 18', the side to side attachment members 30 and 31 are preferably secured to the fabric piece 11' by means of sewing stitches 35, as is shown in FIG. 7.

Therefore, one of the towels 10' can be secured side to side to another towel 10' by overlapping their adjoining side edges 14' and 15', and releasably interlocking the patch of hook-like projections 30 with the patch of loose, fibrous, non-woven material 31 on the other towel 10'. As is shown in FIG. 6, since each towel has a patch of loose, fibrous, non-woven material 31 secured to one of its faces, and patch of hook-like projections 30 secured to the other of its faces, as many of the towels 10' as is desired may be attached together side to side.

The attachment of the towels 10' side to side will aid in preventing the towels from being blown by the wind, and will enable several individuals to use the attached towels 10' as one oversized towel.

In accordance with the above disclosure, both embodiments are characterized by simplicity and economy of construction, since the male and female Velcro patches are simply and easily attached by sewing or some other means of attachment, such as by an adhesive. Likewise, the male and female Velcro patches are formed of nylon or some other synthetic fiber which is substantially impervious to corrosion by salt and hence, will not be subject to corrosion by repeated use, as would a metal zipper or snaps. Furthermore, the manner in which the male and female Velcro members releasably attach to each other render them substantially impervious to damage from sand, unlike metal zippers and snaps, which have rigid parts with relatively close tolerances which must move relative to each other.

Various details of the invention as set forth above may be changed without departing from the scope of the invention. Furthermore, the foregoing description of the preferred embodiments is for the purpose of illustration only, and not for the purpose of limitation—the invention being defined by the claims.

I claim:

1. A beach towel for use with a pillow, and characterized by simplicity and economy of construction, and the use of elements not susceptible to corrosion by salt or damage from sand, comprising:

(a) an elongate, substantially rectangular fabric piece defining opposing, laterally extending top and bottom end edges and opposing, longitudinally extending side edges;

(b) a pair of longitudinaly space-apart and laterally extending attachment members secured to said fabric piece proximate the top end thereof for permitting the top end of said fabric piece to be folded over itself and releasably attached in such position to form a tube for enclosing a pillow, one of said attachment members comprising a patch having numerous rows of hooklike projections, and the other of said pair of attachment members comprising a patch of loose, fibrous non-woven material for releasably interlocking with said hook-like projections; and (c) means for releasably attaching a plurality of said towels together side to side to form an oversized towel for use by several persons and to aid in preventing blowing of said towels by wind, said means comprising a patch of hook-like projections secured to one face of said fabric piece closely adjacent one side edge thereof, and a patch of loose, fibrous non-woven material secured to the other face of said fabric piece closely adjacent the other side edge thereof, whereby one of said towels may be releasably secured to another of said towels by overlapping their ajoining side edges and releasably interlocking said patch of hook-like projections with said patch of loose, fibrous non-woven material.

2. A beach towel according to claim 1, wherein said fabric piece is approximately 30 inches in width and approximately 88 inches in length.

* * * * *